US009534802B2

(12) United States Patent
Zhong et al.

(10) Patent No.: US 9,534,802 B2
(45) Date of Patent: Jan. 3, 2017

(54) VENTILATION DEVICE

(75) Inventors: Bodong Zhong, Guangdong (CN); Min Long, Guangdong (CN); Jiahan Hong, Guangdong (CN); Shi Zhen, Guangdong (CN); Norihiko Hasegawa, Aichi (JP); Ryuuma Yokoyama, Aichi (JP)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 409 days.

(21) Appl. No.: 14/006,230

(22) PCT Filed: Jun. 18, 2012

(86) PCT No.: PCT/CN2012/077082

§ 371 (c)(1),
(2), (4) Date: Nov. 18, 2013

(87) PCT Pub. No.: WO2013/000366

PCT Pub. Date: Jan. 3, 2013

(65) Prior Publication Data

US 2014/0187139 A1 Jul. 3, 2014

(30) Foreign Application Priority Data

Jun. 30, 2011 (CN) ..... 2011 1 0181336
Feb. 10, 2012 (CN) ..... 2012 1 0030448

(51) Int. Cl.
*F24F 7/013* (2006.01)
*F04D 25/10* (2006.01)
(Continued)

(52) U.S. Cl.
CPC ..... *F24F 7/013* (2013.01); *F04D 25/10* (2013.01); *F04D 29/703* (2013.01); *F24F 7/065* (2013.01);
(Continued)

(58) Field of Classification Search
CPC ..... F24F 7/013; F24F 7/065; F24F 7/14
(Continued)

(56) References Cited

U.S. PATENT DOCUMENTS 1,955,088 A * 4/1934 Pine ..... B61D 27/009 454/116
2,619,021 A 11/1952 Pfautsch
(Continued)

FOREIGN PATENT DOCUMENTS

CN 2337438 9/1999
CN 2733223 10/2005
(Continued)

OTHER PUBLICATIONS

Entire patent prosecution history of U.S. Appl. No. 13/457,666, filed Apr. 27, 2012, entitled, "Ventilating Fan," now U.S. Pat. No. 9,033,684, issued May 19, 2015.
(Continued)

*Primary Examiner* — Steven B McAllister
*Assistant Examiner* — Jonathan Cotov
(74) *Attorney, Agent, or Firm* — RatnerPrestia

(57) ABSTRACT

Ventilation device is mounted on inner wall in wind tunnel communicating between indoor and outdoor sides, having a ventilation louver. The ventilation louver includes a louver frame and a movable louver. Horizontal distance from position of gravity center of the movable louver to the inner wall is greater than horizontal distance from the movable louver shaft to the inner wall. A lever is disposed at a lower part of the louver frame to move in a left-right direction
(Continued)

along bottom end face of the lower part of the louver frame. A connection element is provided to connect the movable louver with the lever between the movable louver and the louver frame, which is configured to be a slidable structure in the up-down direction, and transform the movement in the left-right direction of the lever to opening and closing movement of the movable louver around the movable louver shaft.

18 Claims, 13 Drawing Sheets

(51) Int. Cl.

| | |
|---|---|
| ***F04D 29/70*** | (2006.01) |
| ***F24F 13/10*** | (2006.01) |
| ***F24F 13/14*** | (2006.01) |
| ***F24F 11/00*** | (2006.01) |
| ***F24F 7/06*** | (2006.01) |
| *F24F 13/28* | (2006.01) |

(52) U.S. Cl.
CPC ..... *F24F 11/0001* (2013.01); *F24F 13/10* (2013.01); *F24F 13/14* (2013.01); *F24F 13/28* (2013.01)

(58) Field of Classification Search
USPC ..... 454/207
See application file for complete search history.

(56) References Cited

U.S. PATENT DOCUMENTS

| | | | | | |
|---|---|---|---|---|---|
| 2,837,021 | A * | 6/1958 | McLarty | F04D 25/12 | 454/348 |
| 3,288,508 | A | 11/1966 | Maize | | |
| 3,635,001 | A | 1/1972 | Komroff | | |
| 4,843,298 | A | 6/1989 | Brauch | | |
| 6,149,698 | A * | 11/2000 | Uehara | F24F 7/013 | 454/351 |
| 6,241,600 | B1 * | 6/2001 | Uehara | F24F 7/013 | 454/235 |
| 6,435,962 | B1 * | 8/2002 | Herron | F24F 13/1413 | 454/290 |
| 6,453,972 | B1 * | 9/2002 | Sher | E06B 9/34 | 160/133 |
| 7,641,125 | B2 * | 1/2010 | Rimmer | F24F 11/053 | 236/49.3 |
| 8,371,913 | B1 * | 2/2013 | Taylor | F24F 7/013 | 454/210 |
| 8,419,515 | B1 * | 4/2013 | Dillon | F24F 13/084 | 454/284 |
| 9,033,684 | B2 * | 5/2015 | Long | F04D 25/0693 | 417/423.15 |
| 2004/0171345 | A1 * | 9/2004 | Pesch | B60H 1/3414 | 454/319 |
| 2006/0079171 | A1 * | 4/2006 | Lu | F24F 13/1426 | 454/325 |
| 2006/0243814 | A1 * | 11/2006 | Rimmer | F24F 11/053 | 236/49.3 |
| 2007/0012192 | A1 | 1/2007 | Pippel | | |
| 2009/0149124 | A1 * | 6/2009 | Stevenson | B60H 1/00671 | 454/358 |
| 2014/0187139 | A1 | 7/2014 | Zhong | | |

FOREIGN PATENT DOCUMENTS

| | | |
|---|---|---|
| CN | 101430129 | 5/2009 |
| CN | 101446432 | 6/2009 |
| CN | 101796348 | 8/2010 |
| JP | 2000-346411 | 12/2000 |
| JP | 2000346411 | * 12/2000 |
| JP | 2001336795 | 12/2001 |
| JP | 2005083587 | 3/2005 |
| JP | 2006-162138 | 6/2006 |
| JP | 4391168 | 12/2009 |

OTHER PUBLICATIONS

Entire patent prosecution history of U.S. Appl. No. 13/683,039, filed Nov. 21, 2012, entitled, "Ventilating Fan."
Machine Translation of the Publication No. JP 2005-835870
Raw Machine Translation of the Japanese Publication JP 2001-336795A, Makino et al., Ventilator, Dec. 2001.
International Search Report for International Appln. No. PCT/CN2012/077082, dated Sep. 20, 2012.
Written Opinion for International Appln. No. PCT/CN2012/077082, dated Sep. 7, 2012.
Non-Final Office Action mailed Feb. 1, 2016 in U.S. Appl. No. 13/683,039.
Final Office Action for U.S. Appl. No. 13/683,039, dated May 19, 2016.
Non Final Office Action for U.S. Appl. No. 13/683,039, mailed Aug. 25, 2016, 11 pages.

* cited by examiner

VENTILATION DEVICE

CROSS-REFERENCE TO RELATED APPLICATIONS

This application is based on the PCT international application PCT/CN2012/077082 and claims the benefit of Chinese patent application No. 201110181336.9 and No. 201210030448.9, filed on Jun. 30 23, 2011 and Feb. 10, 2012 respectively with SIPO of China, and the disclosures of which are incorporated herein in its entirety by reference.

BACKGROUND OF THE INVENTION

Field of the Disclosure

The present invention relates to a ventilation device.

Description of the Related Art

In the prior art, the conventional ventilation device is provided with a driving machine, which controls opening/closing action of an ornamental panel board. For example, JP2000-346411 discloses a ventilation device. With reference to FIGS. 13 and 14, the conventional ventilation device is described in detail below.

As illustrated in Figures, a ventilation device includes a removable ornamental panel board 103 on side of suction air port, in front of a body frame 102 of a wind tunnel with a ventilating blower 101 built therein. A ventilating air flow is created from a flared suction air port 106 in a front side of the body frame 102 towards an air outlet at rear side of the body frame 102. A panel frame portion 107 of the ornamental panel 103, which is configured to be able to be opened forward, and the bottom end side thereof are supported by a shaft. A movable louver portion 109 of the ornamental panel 103 is disposed in the ornamental panel 103 to be rotated by a drive means, thereby forming a substantial sectorial ventilating space 108 by the movable louver portion 109 and the periphery portion of the panel frame portion 107.

The panel frame portion 107 has a protrusion part 110, a front face of which is joined with circumference side of the body frame 102. The protrusion part 110 is formed at a higher position than lower portion of the movable louver portion 109 on the shaft supported side. The upper portion of the movable louver portion 109 on the side opposite to the shaft supported side is formed in an arc shape and the height thereof is gradually reduced. A lower edge portion 111 of the front face of the panel frame portion 107 is in part formed to protrude forward so as to provide a section difference part 112, which provides a gap as a downward slot-shaped insertion port 113 for the movable louver portion 109. Further, the movable louver portion 109 protrudes at a lower edge thereof to provide a support flange 118, which is rotatably cooperated with the insertion port 113 of the panel frame portion 107. Upon inserting the support flange 118 into the insertion port 113, the shaft supported movable louver portion 109 is supported by the support flange 118, as a pivot point, so as to be rotatable.

A spring 121 is provided as a resilience component between rear side of the movable louver portion 109 and front face of the panel frame portion 107, and urges them to abut against to each other. The driving unit comprises a driving machine 122, a transmission mechanism and a crank 123. The driving machine 122 is mounted so as to be close to lower portion of the panel frame portion 107 and includes electrical wire 124 winded therein, which may be sent out in succession. The crank 123 is formed in M shape and located just under center of the front opening portion of the panel frame portion 107. The crank 123 is supported by a support formation 125 at both ends thereof and is configured to be rotatable.

In addition, when the wire 124 is driven by the driving machine 122, the crank 123 is rotated so as to push rear side of the movable louver portion 109, against the resilience force from the spring 121. As a result, the movable louver portion 109 is rotated and opened.

As for such ventilation device in prior art, a driving machine for opening and closing the movable louver and a driving mechanism including a spring and a crank are needed. This in turn makes the structure of the conventional ventilation device complicated.

In addition, when difference between indoor and outdoor temperatures is large and such conventional ventilation device has been operated for long time, temperature of the body thereof will be decreased as sucking in cool air outside of the chamber. When inside warm air from the chamber contacts indoor outer surface of the movable louver portion 109, it will be cooled and condensed to generate liquid droplets, which slides down along the louver portion 109 and falls into indoor room. These condensed droplets degrade environmental sanitation and causes humidity and mold.

SUMMARY OF THE DISCLOSURE

The present invention has been made to overcome or alleviate at least one of the above-mentioned problems and drawbacks existing in the prior arts.

Accordingly, it is an object of the present invention to provide a ventilation device with a movable louver, which is openable and closable with a simplified structure.

It is also a second object of the present invention to provide a ventilation device where the out appearance is kept to be dry.

In order to achieve the above objects, a ventilation device is provided, mounted on inner wall in wind tunnel communicating between indoor and outdoor sides, having a ventilation louver. The ventilation louver includes a louver frame and a movable louver. The louver frame is mounted at a front opening of the ventilation device body and the movable louver is supported by a movable louver shaft at lower part of the louver frame and covers a front of the louver frame. A horizontal distance from position of gravity center of the movable louver to the inner wall is greater than a horizontal distance from the movable louver shaft to the inner wall. An lever is disposed at a lower part of the louver frame to move in a left-right direction along bottom end face thereof. A connection element is provided to connect the movable louver and the lever between the movable louver and the louver frame, which is designed to be a slidable structure in up-down direction. By means of the connection element the movement in left-right direction of the lever causes opening and closing movement of the movable louver around the movable louver shaft.

With such structure, the lever is moved in a left-right direction, driving the connection element to move in up-down direction and in turn causing rotation of the movable louver around the movable louver shaft, i.e., opening and closing thereof. When the movement of the lever and the connection element is stopped, the movable louver may be kept at any position. Thus, a ventilation device comprising a ventilation louver is provided according to the present invention. In the embodiment, the ventilation louver may be performed to opened and closed by means of a simple structure, without a complex driving mechanism. Further, the ventilation louver may be operated by the lever by user under the ventilation device to achieve opening and closing thereof, even though it is mounted at a higher position.

In addition, the connection element is designed to be a slidable structure in an up-down direction. With this structure, the connection element may be configured to have a smaller thickness and in turn the thickness of the louver frame may be configured to be smaller, thereby improving appearance of the ventilation device.

The lever includes a horizontal groove disposed in its end face facing a lower part of the louver frame opening portion. Meanwhile, a corresponding protrusion plate is disposed to extend in a left-right direction on the lower part of the louver frame opening portion, the protrusion plate being fitted in the groove and slidable in a left-right direction therein. The lever includes a handle extending downward and projecting to indoor room from a bottom of the louver frame.

The movable louver is provided with a rotation guide plate standing on its back side, in which an oblique rotation guide slot is formed. The U-shaped connection element is provided with a protrusion part on a front end of the portion in up-down direction thereof, the protrusion part of the connection element being fitted and slidable in the rotation guide slot at a central position of both sides of the movable louver. The rotation guide plate moves forward and backward when the connection element moves in an up-down direction. With this structure, at a substantial central position of both sides of the movable louver, the movable louver may be pulled by the connection element, thus the pulling force is reduced. Further, since the connection element is configured to exert force on the movable louver at two sides including right side and left side of the movable louver, the movable louver is not prone to be tilted in left-right direction. That is, the movable louver may abut against the louver frame, or may be opened while maintaining an even gap from the louver frame. Further, the pulling force can be equably applied to the movable louver, thereby ensuring smooth opening and closing of the movable louver.

The connection element includes oblique lever guiding slots, and the lever includes an lever protrusion fitted in the lever guiding slot. The lever protrusion is slidable in an lever guiding slot, such that the connection element moves in up-down direction when the lever moving in left-right direction. The lever protrusion is cylindrical or elongate. With this structure, the connection element may be forced to an upmost position within its movable range by an upper portion of the lever protrusion and to bottom of the movable range by lower portion thereof. Thus, the movable extent of the connection element becomes larger. To maintain a same movable range, the height of the horizontal part of the connection element can be reduced, such that the opening area of the opening portion for blowing air in the louver frame becomes larger and thus reducing loss in ventilating pressure.

The rotation guide slot in the rotation guide plate comprises one or more slot parts with different gradient, or an arc-shaped slot. For a slot comprising at least two slot parts with different gradient, with respect to horizontal plane, the slot part with smaller gradient of the rotation guide slot is disposed in a rear side while the slot part with greater gradient is in a front side. With this structure, the direction, in which force acts on the rotation guide slot of the movable louver, may be changed by changes of position of the connection protrusion of the connection element moving in up-down direction, thereby the movable louver is smoothly opened and closed.

The connection element is U-shaped and the lever guiding slot is located in a central portion of the U-shape connection element in the left-right direction. With this structure, since force is transferred from the lever protrusion in the lever to a substantial center of the connection element, the joint of the movable louver at both sides thereof to the connection element may be pulled equably and evenly by the connection element. Thus, the movable louver does not tend to be tilted in left-right direction. The movable louver may abut against the louver frame, and thus can be opened while maintaining an even gap from the louver frame. Further, driving force may be evenly transferred to the movable louver, thereby ensuring smoothly opening and closing of the movable louver.

In addition, connection element support portions are disposed at upper end and lower end of the lever guiding slot formed in the connection element for fixing the lever protrusion. With this structure, since the connection element may be fixed, the movable louver may be fixed at its opening or closing state.

A heat insulating material is provided on the inner surface of the movable louver.

To edge of the upside bracket and right and left side bracket of the movable louver, a double convex bar structure comprising an inner protruding bar and an outer protruding bar is provided and a space is disposed between the inner and the outer protruding bars.

A protruding bar is disposed in the space to connect inner convex bar and outer convex bar and thereby a reservoir is formed between the protruding bar, the inner convex bar and outer convex bar.

The ventilation device body is provided with a filter bracket, which is snapped to the ventilation device body and formed in a shape to cover front opening of the ventilation device body. A seal sponge is further provided to an inner side of the louver frame to block a gap between the filter bracket and the ventilation device body.

The ventilation device body is provided with a wind guiding structure, located at position where the ventilation device body snaps to the filter bracket, through which cool air is blown to wall shielded by the ventilation device body.

With the above configuration, the present invention at least has the advantage as follows: the movable louver can be opened and closed by a simplified structure; the user may open and close the louver of the ventilation device located in a higher position by operating the lever; and the outer appearance of the ventilation louver may be kept in a dry environment.

REFERENCE NUMBER LIST

1 indoor; 2 outdoor; 3 wall; 4 perforation; 5 ventilation device body; 6 wind tunnel part; 7 flange part; 8 motor support part; 9 motor; 10 motor shaft; 11 fan; 12 protrusion part; 13 the ventilation louver; 14 louver frame; 15 movable louver; 16 top sidewall; 17 bottom sidewall; 18 louver frame opening portion; 19 movable louver shaft; 20 claw W1 centre of gravity position; 21/21' connection element; 22 connection protrusion; 23 lever guiding slot; 24 support portion of connection element; 25 lever; 26, 26' lever protrusion; 27 upper protrusion part; 28 lower protrusion part; 29 connecting member cover; 30 slot; 31*a* rotation guide plate; 31*b* rotation guide plate; 32 rotation guide slot; 33 upper guide slot; 34 lower guide slot; 35 heat-insulating material; 36 opening part edge; 42 groove; 43 protrusion plate; 51 inner convex bar; 52 outer convex bar; 54 outer surface; 55 space; 56 protruding bar; 141 filter bracket; 142 space; 143 seal sponge; 144 wind guiding structure; 145 snap sheet; 146 opening

DETAILED DESCRIPTION OF THE PREFERRED EMBODIMENT

An embodiment of the present invention is described as below in detailed with reference to the Figures.

Figure 1:
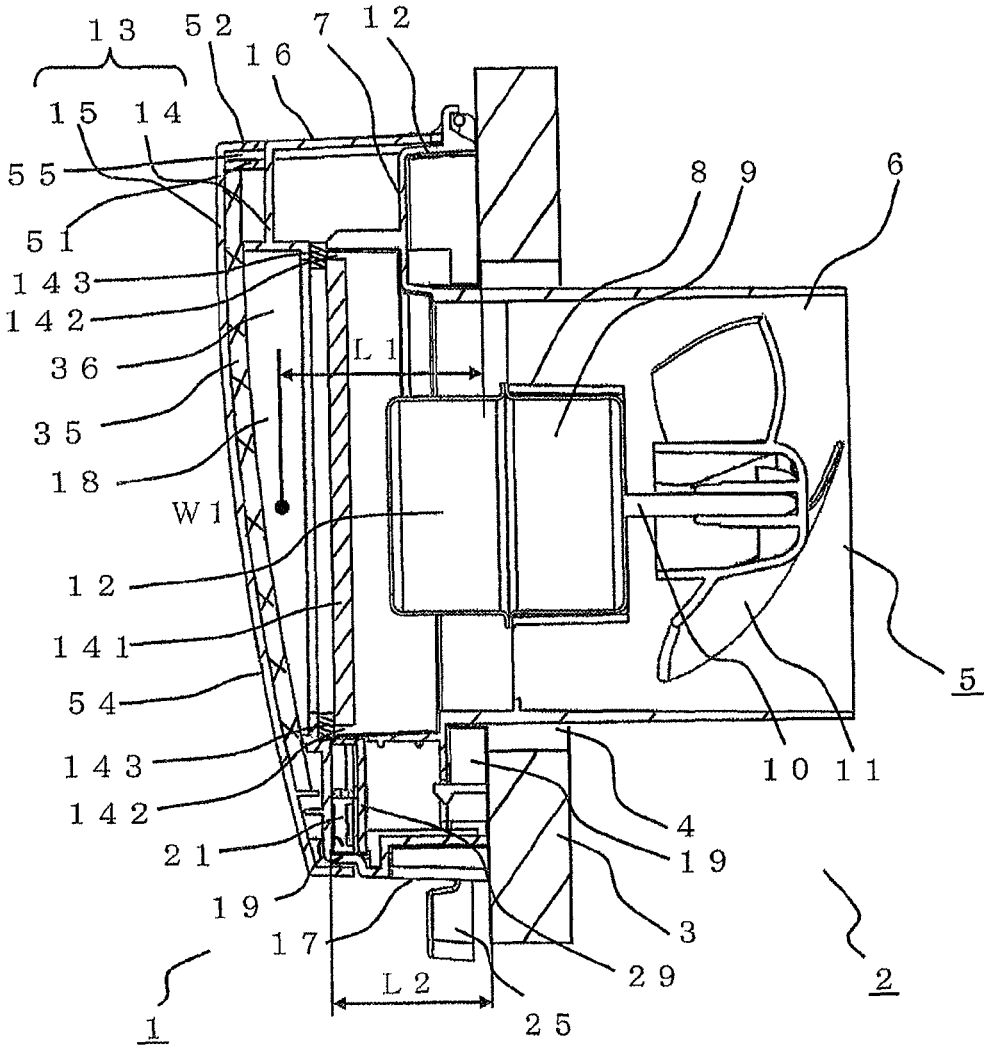
FIG. 1 is an entire sectional view of a ventilation device with a movable louver in a closed state according to the present invention.
Figure 2:
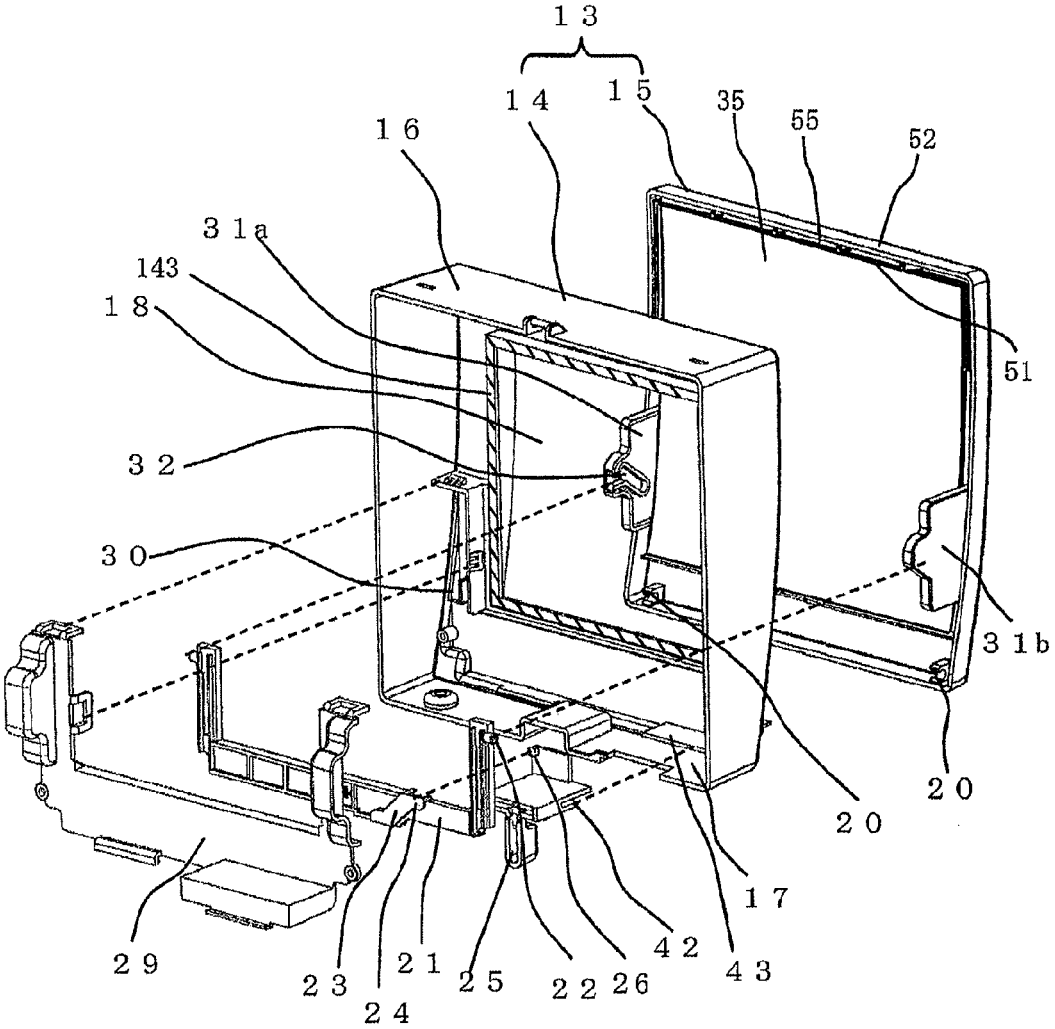
FIG. 2 is an exploded view of the ventilation louver according to the present invention, viewed from inside thereof.
Figure 12:
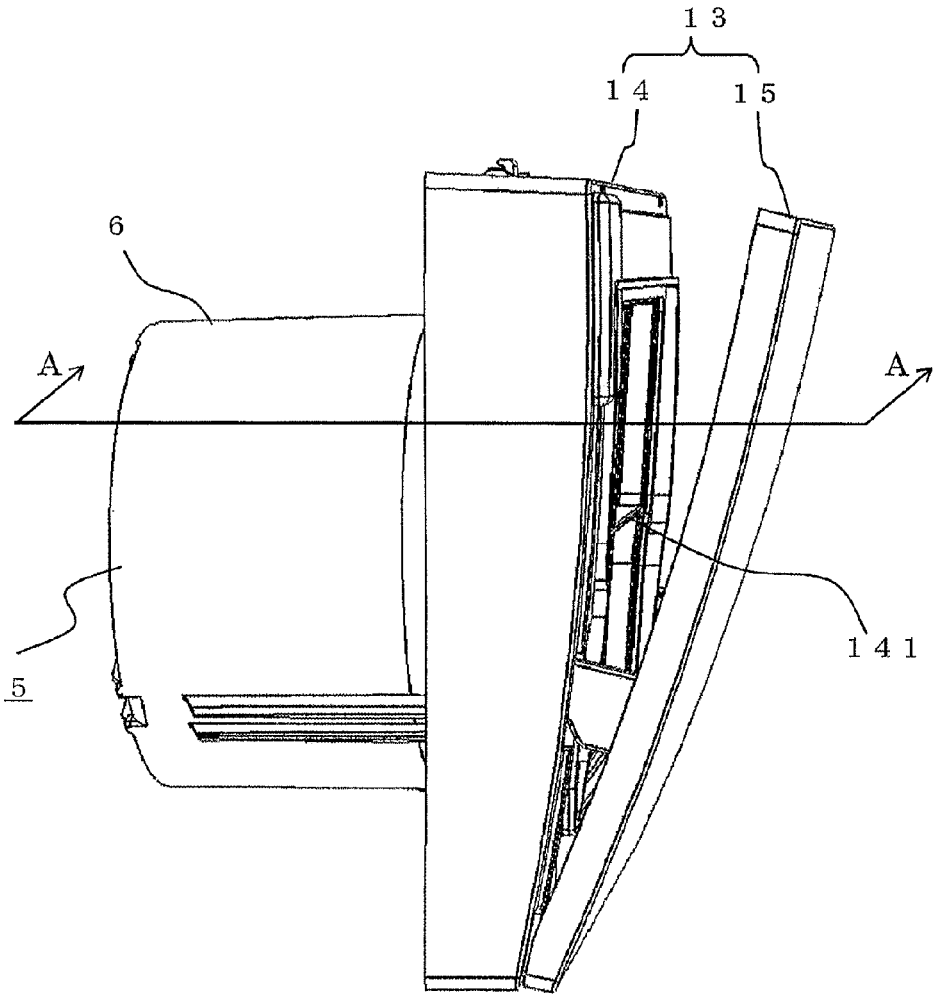
FIG. 12 is an entire schematic view of the ventilation device according to the present invention.
Figure 13:
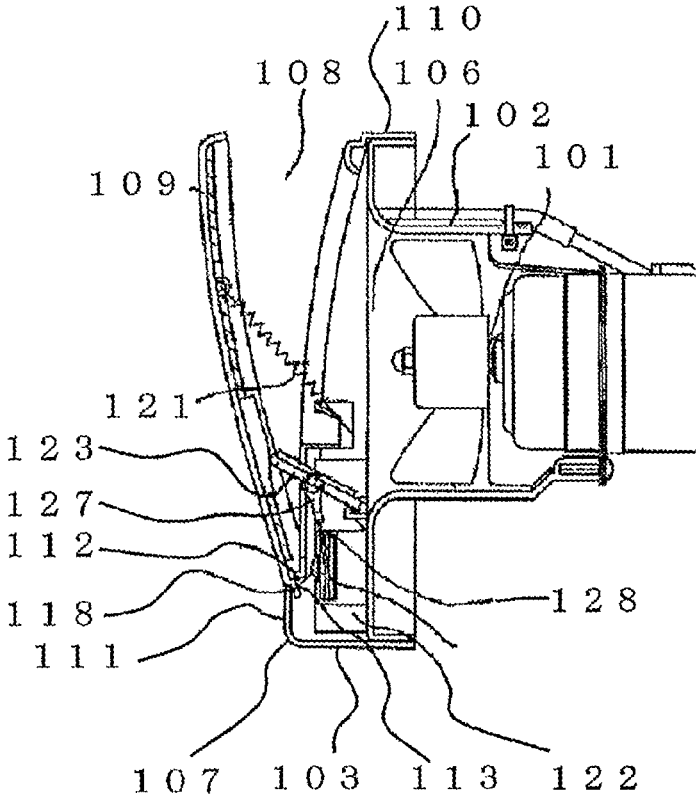
Fig. 13 Prior Art
FIG. 13 is a sectional view of the conventional ventilation device with the movable louver in an opened state.
Figure 14:
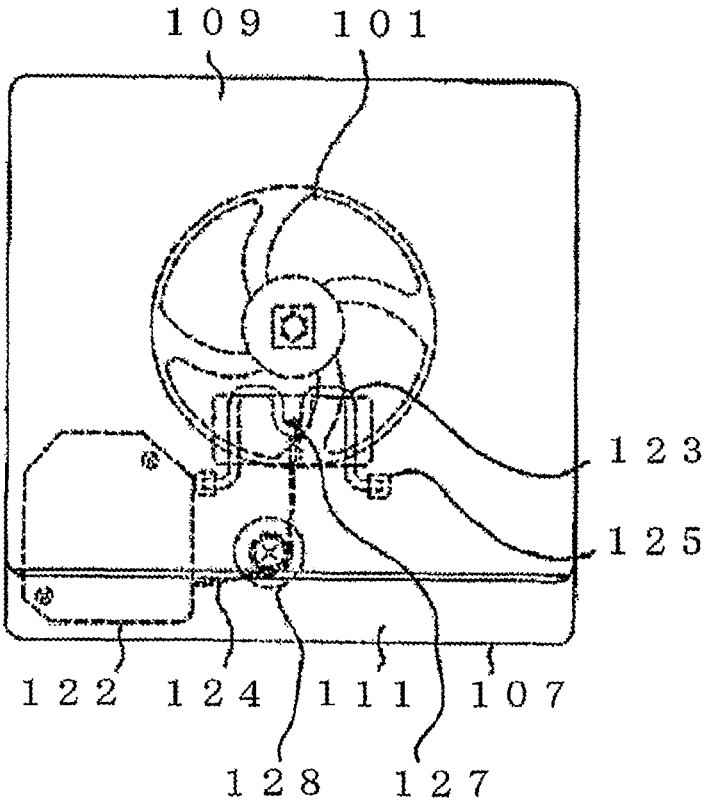
Fig. 14 Prior Art
FIG. 14 is a front view of the ventilation device in prior art.

As shown in FIGS. 1, 2 and 12, a wall 3 separating indoor 1 from outdoor 2 space is formed a perforation 4 therein, which is used to form a wind tunnel. A ventilation device body 5 is mounted in the perforation 4. The ventilation device body 5 comprises a wind tunnel part 6 and a body flange part 7, in which the wind tunnel part 6 is in a cylindrical shape. In the wind tunnel part 6, a motor support part 8 is mounted, on which a motor 9 is installed. A fan 11 is fitted on a motor shaft 10 for blowing air from outdoor to indoor. On one hand, the body flange part 7 is formed on the indoor 1 side of the wind tunnel part 6 around edge of the opening portion and protruded in square shape. The body flange part 7 is provided with a protrusion part 12 projecting from the rear side thereof. In the body flange part 7, four protrusion parts 12 are disposed to project away rear side of the body flange part 7.

The ventilation louver 13 comprises a louver frame 14 and a movable louver 15. The louver frame 14 is fitted on the ventilation device body 5 and configured to have a front opening. The movable louver 15 covers a front face of the louver frame 14 and is supported by a movable louver shaft located in lower part of the louver frame 14. The louver frame 14 is engaged with the protrusion part 12 of the ventilation device body 5.

The projecting length of top sidewall 16 of the louver frame 14 is larger than that of bottom sidewall 17 thereof. The louver frame 14 is provided on its front side with a louver frame opening portion 18 and a horizontal movable louver shaft 19 parallel to the wall 3 on bottom side thereof, which is configured to support the movable louver 15.

The movable louver 15 covers the front face of the louver frame 14. From a top to bottom direction, the movable louver 15 becomes closer to the wall 3, such that the cross section thereof is shown as a circular arc. That is, a horizontal distance L1 from the gravity centre position W1 to surface of the wall 3 is greater than a horizontal distance L2 from the movable louver shaft 19 to surface of the wall 3.

Furthermore, a U-shaped connection element 21 slidable in up-down direction and a lid 29 covering the connection element 21 are inserted into a lower part of the louver frame 14. The connecting member cover 29 is embedded in the louver frame 14. Further, the connection element 21 is configured to be movable in the space formed by the connecting member cover 29 and the louver frame 14. That is, the connecting member cover 29 functions to limit movement of the connection element 21 in the above space. To the bottom of the louver frame 14, an lever 25 is mounted to snap with the connection element 21, which may be slid in left-right direction. The lever 25 extends down from the louver frame 14 to indoor room 1.

Figure 3:
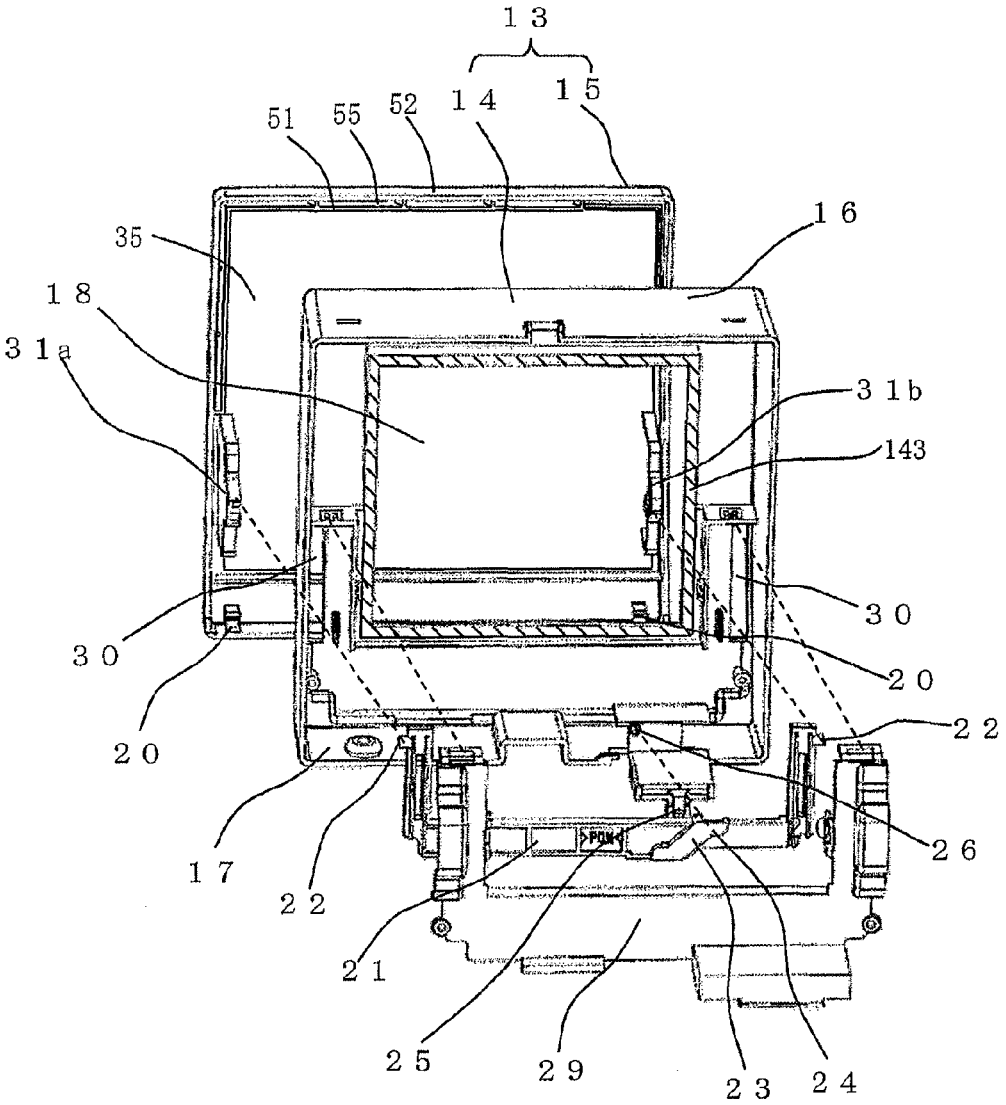
FIG. 3 is an exploded view of the ventilation louver according to the present invention, viewed at another viewing angle from inside thereof.
Figure 4:
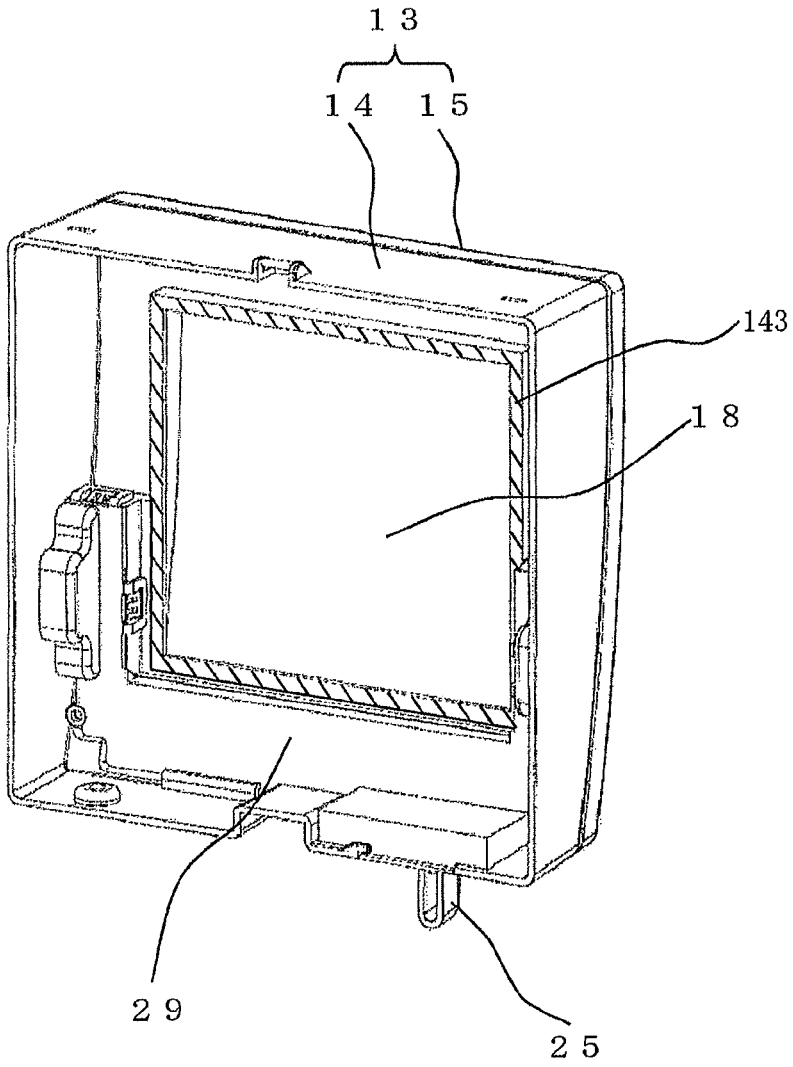
FIG. 4 is a front view of the ventilation louver with a connection element and lever thereof assembled according to the present invention.
Figure 5:
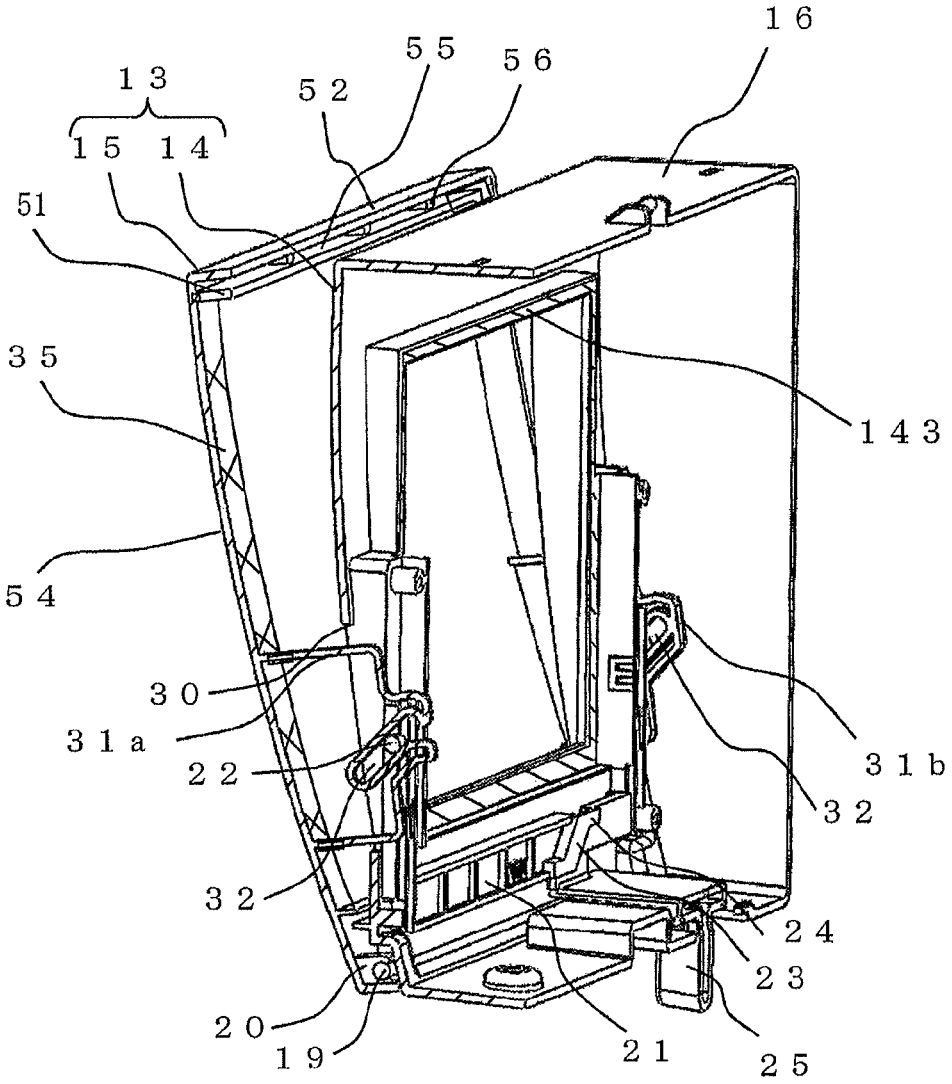
FIG. 5 is a sectional view of the ventilation louver with the movable louver in an opened state according to the present invention.

The ventilation louver 13 is described further in detailed with reference to FIGS. 2 to 6. In addition, throughout FIGS. 2 to 6, the same reference numbers for the parts in FIG. 1 are also used for the similar parts and thus the explanation for those parts is omitted. In FIGS. 2 and 3, the dash line is used to schematically illustrate the assembly relationship between the connection element 21, the louver frame 14 and the lever protrusion 26.

In rear side of the movable louver 15, claws 20 are provided to join the movable louver shaft 19 and support the movable louver 15. Slots 30 are disposed on either side of the louver frame opening portion 18 of the louver frame 14, through which corresponding rotation guide plate 31*a*, 31*b* formed on either side of the movable louver 15 are inserted.

In the rotation guide plate 31*a*, 31*b*, rotation guide slots 32 are formed in a shape such that the slot extends away from the movable louver 15 from lower end to the upper end of the slot. A connection protrusion 22, which is formed in front end of parts of U-shaped connection element 21 in an up-down direction, is fitted in the rotation guide slot 32. Furthermore, with respect to the up-down direction in FIG. 2, an lever guiding slot 23 is formed in horizontal part of U-shaped connection element 21, which is inclined towards right side (that is, in FIG. 2, upper end is in right side with relative to lower end). An lever protrusion 26 formed in the lever 25 is fitted in the lever guiding slot 23.

Figure 6:
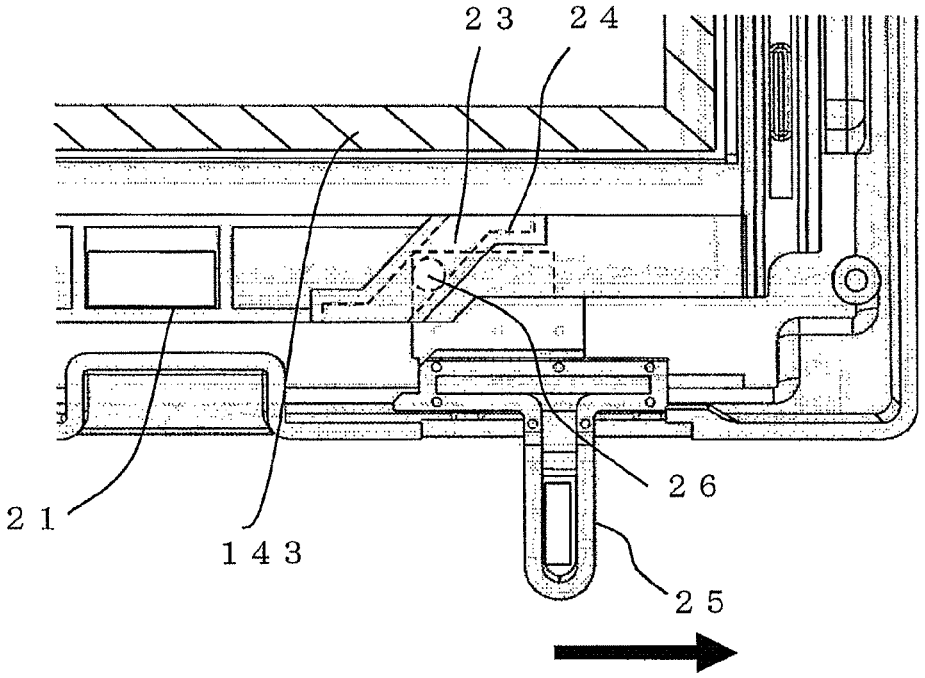
FIG. 6 is a schematic view of movement of the lever of the ventilation device according to the present invention.

The action of the lever 25 is interpreted below. As shown in FIGS. 2 and 3, a handle of the lever 25 is configured to project downwards from bottom side of the louver frame 14 and extend to the indoor side. A recess 42 extended in a left-right direction is provided in a surface of the lever 25 facing to the ventilation louver 13. To the end face of the louver frame opening portion 18, a protrusion plate 43 is disposed, which is fitted and removable in left-right direction in the recess 42. As shown in FIG. 6, when the lever 25 is moved to right side, as denoted by the arrowhead, the lever protrusion 26 is moved to upper end along the lever guiding slot 23. The connection element 21 is configured to be a slidable formation in the up-down direction. The connection element 21 is caused to move downwards, due to inclination of the lever guiding slot 23, when the lever protrusion 26 is moved along the lever guiding slot 23.

Figure 7:
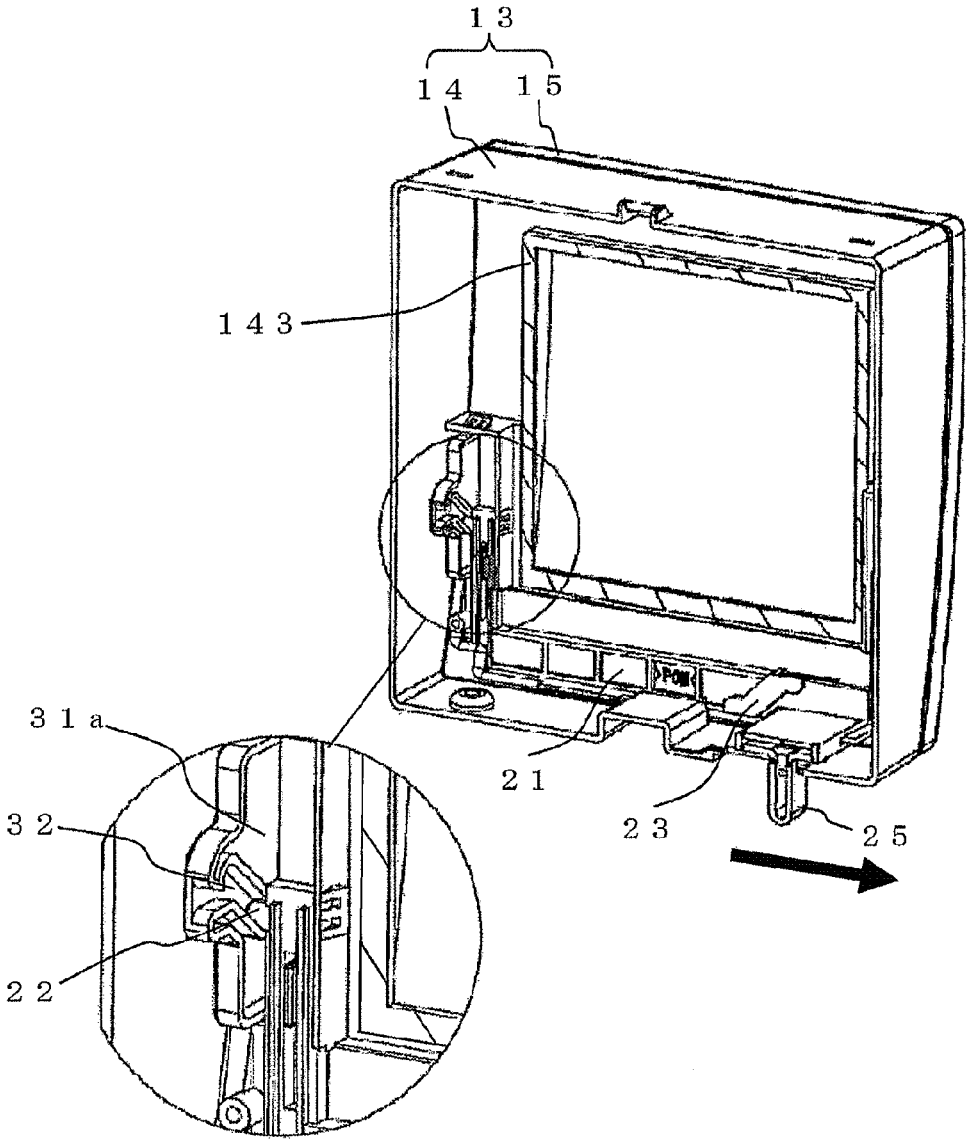
FIG. 7 is a perspective view of the ventilation louver in a closed state according to the present invention, viewed from inside.

Since the connection protrusion 22 disposed at connection element 21 is movably engaged with the guide slot 32, the movement in the up-down direction of the connection element 21 will be transformed to opening and closing of the movable louver 15. Specifically, as illustrated in FIGS. 5 to 8 again, when the connection element 21 is moved downward, the connection protrusion 22 located thereof is consequently moved downward along the rotation guide slot 32 in the rotation guide plate 31*a*, 31*b*. Since the lower end of the rotation guide slot 32 is configured to be more remote from the wall 3, when the connection protrusion 22 is moved downward, the rotation guide slot 32 is forced to move toward the wall 3, thereby the movable louver 15 is force to move toward the connection element 21. That is, the movable louver 15 is rotated in a closing direction, as shown in FIG. 7.

Figure 8:
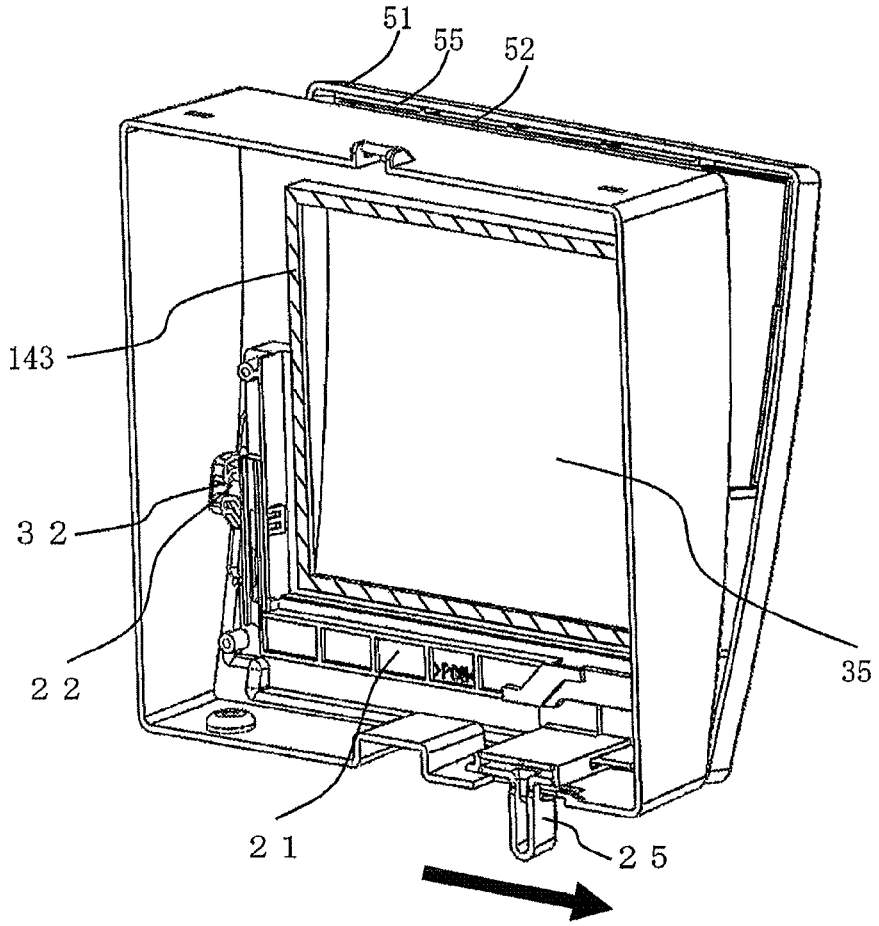
FIG. 8 is a perspective view of the ventilation louver in an opened state according to the present invention, viewed from inside.

In addition, if the lever 25 is moved from the position shown in the FIG. 6 toward a leftward direction, the connection element 21 is moved upward and the movable louver 15 is opened, by movement of the lever protrusion 26 movable fitted in the lever guiding slot 23 in the connection element, as shown in FIG. 8.

As described above, the movable louver 15 is configured in such formation that it is pivoted by the movable louver shaft 19 of the shaft support portion and upper part of the movable louver 15 is tilted, hereby the movable louver 15 is opened. Conversely, when the connection element 21 is moved toward the lower side, the movable louver 15 is closed.

Further, due to the rotation guide plate 31*a*, 31*b* disposed on left and right sides of the formation respectively, the movable louver does not tend to tilt even it is pulled in left and right directions.

By arranging the connection protrusion 22 of connection element 21 and the rotation guide slot 32 disposed in the movable louver 15 close to bottom part of the movable louver 15, a space may be ensured between the connecting member cover 29 and the wall 3. Since the ventilation louver 13 is finally snapped with the ventilation device body 5 while the body flange part 7 of the ventilation device body 5 is embedded in the louver frame 14, a space is provided between the connecting member cover 29 and the wall 3 so as to be fitted by the body flange part 7 of the ventilation device body 5. In other words, the bottom sidewall 17 may be configured to be thinner, thereby improving outer appearance of the ventilation device.

Figure 9:
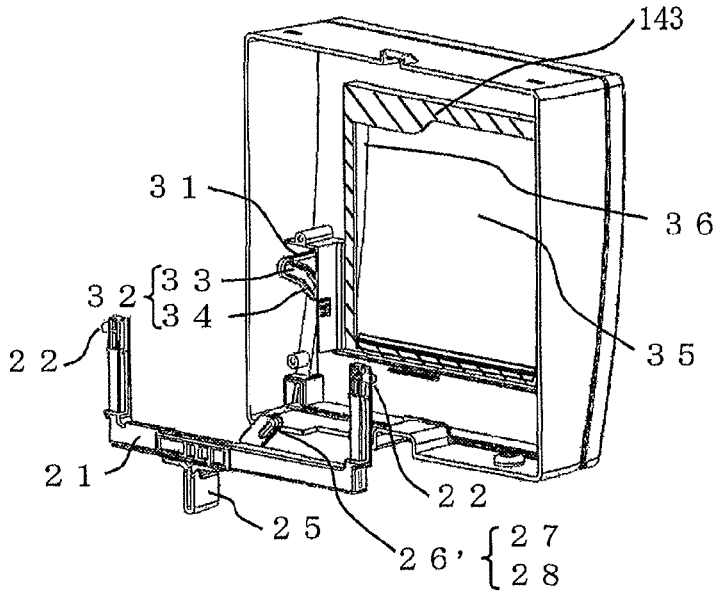
FIG. 9 is an exploded perspective view of the movable louver according to the present invention, viewed from inside.
Figure 10:
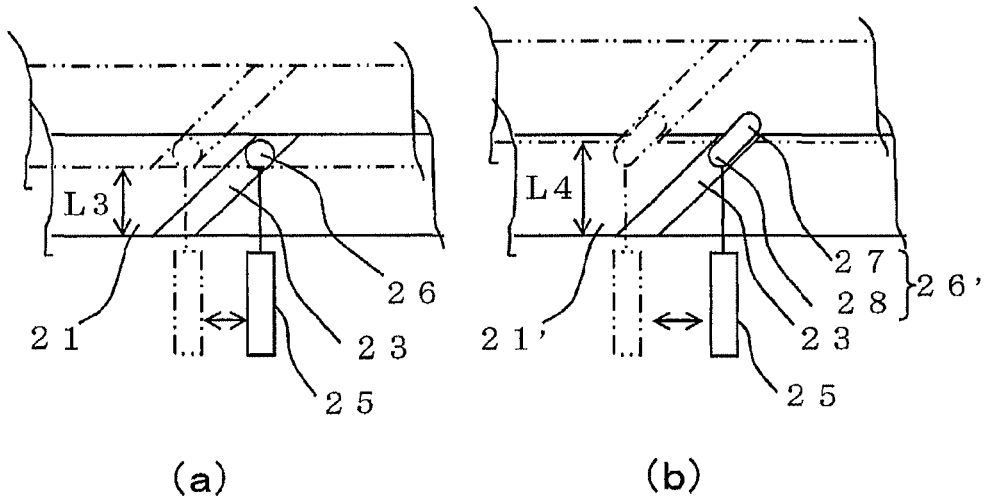
FIGS. 10A and 10B are schematic views illustrating the connection element lever protrusion in different shapes.

In FIG. 6, the lever protrusion 26 is cylindrical. However, the lever protrusion 26 according to the present invention may be in other shapes. As shown in FIGS. 9 and 10(*b*), the lever protrusion 26' is in an elongate shape, in which upper part and lower part thereof may have a semicircle cross-section; The lever protrusion 26' includes an upper protrusion part 27 and a lower protrusion part 28.

The lever protrusion 26 schematically illustrated in FIG. 10(*a*) is similar to that in FIG. 6. From FIG. 10(*a*), the lever protrusion 26 is movable in a left-right direction, which thus forces the connection element 21 to move in an up-down direction. The maximum range the connection element 21 may move, as shown by L3, is limited by that the lever protrusion 26 cannot leave the lever guiding slot 23.

However, as further illustrated in FIG. 10(*b*), due to its elongate shape, the lever protrusion 26' would not fall off from the lever guiding slot 23 as long as part of it is held therein. Thus, the connection element 21' is illustrated in FIG. 10(*b*) to be able to be pushed to positions in higher or lower level. That is, the movable range of the connection element 21', L4, becomes larger. Thus, compared to the situation shown in FIG. 6, to maintain the same movable range, the height of the horizontal part of the connection element 21' can be reduced, such that the opening area of the louver frame opening portion 18 for blowing air in the louver frame 14 becomes larger and thus reducing loss in ventilating pressure. The horizontal movement of the lever 25 is transformed to movement of the connection element 21 in an up-down direction via the lever guiding slot 23.

In addition, as shown in FIG. 9, the rotation guide slots 32 formed in rotation guide plate 31*a*, 31*b* comprises an upper guide slot portion 33 and a lower guide slot portion 34 with different gradient. That is, with respect to left-right direction, the gradient of the upper guide slot portion 33 may be smaller with relative to that of the lower guide slot portion 34. A transition arc may be configured between the upper guide slot portion 33 and the lower guide slot portion 34. The connection protrusion 22 disposed in the connection element 21 is fitted in the rotation guide slot 32.

With the above configuration, if user tends to close the movable louver 15 by the lever 25, the connection element 21 descends downward. Further, when the connection protrusion 22 is fitted and moved in the lower guide slot portion 34, compared to the situation where the connection protrusion 22 is fitted and moved in the upper guide slot portion 33, the movable louver 15 is rotated within a smaller angle with respect to the descending movement the connection element 21. In the meanwhile, the action where the connection protrusion 22 is applied on the rotation guide slot 32 for closing the movable louver, and a heat-insulating material 35 attached to the movable louver 15 is forced to abut on the opening part edge 36, thus improving air-tightness between the movable louver 35 and the opening part edge 36.

In a reverse operation, if user tends to open the movable louver 15, he may operate the lever 25 to cause the connection element 21 to move upwards and thus bring the connection protrusion 22 to the upper guide slot portion 33. Here, since angle of the upper guide slot portion 33 with relation to the opening direction of the movable louver becomes smaller, the movable louver 15 smoothly rotates in opening direction by its own weight.

In addition, in this embodiment, the rotation guide slot 32 comprises two slot parts with different gradient. With respect to horizontal plane, the slot part with smaller gradient of the rotation guide slot 32 is disposed in rear side while the slot part with greater gradient is in a front side. The rotation guide slot 32 may include slot parts with three or more gradients, or may be in arc shape.

As shown in FIG. 9, an lever guiding slot 23 is formed in substantial center of the connection element 21 in a left-right direction. The lever protrusion 26 is brought to fit in the lever guiding slot 23 close to center of the movable louver 15. With the above configuration, as force is transferred from the lever protrusion 26 disposed on the lever 25 to substantial center of the connection element 21, the movable louver 15 can be rotated at a constant speed by pulling the rotation guide slots 32 disposed on both sides of the movable louver 15 and engaged to the connection element 21. The movable louver 15 is not prone to tilt. That is, the movable louver 15 can abut on the louver frame 14, or can be opened while maintaining a uniform gap from the louver frame.

Further, the driving force can be equably transferred to the movable louver 15, thereby ensuring smooth opening and closing of the movable louver 15.

Furthermore, as shown in FIG. 6, connection element support portions 24 are configured in upper end and lower end of the lever guiding slot 23 formed in the connection element 21. The connection element support portion is formed to be horizontal slot. The connection element support portion may be fitted in the lever protrusion 26 of the lever 25. With this configuration, when the lever 25 is moved to right side in arrowhead direction as shown in FIG. 6, the connection element 21 engaged to the lever protrusion 26 will be moved downward. Further, as the lever 25 is moved further toward right side, the lever protrusion 26 will be fitted in the connection element support portion 24. When the lever protrusion 26 is placed in the connection element support portion 24, the connection element 21 is fixed because the connection element 21 cannot be moved in up-down direction. Thus, the movable louver 15 is affixed.

While a "rotation guide slot 32" is illustrated in the embodiment, any other formations used to engage or fit to the connection protrusion 2 on the connection element 21 may be used. For example, it can have a shape of perforated elongate hole.

In the ventilation device according to the present invention, a ventilation louver is provided, mounted to the ventilation device body, comprising a louver frame with a front opening and a movable louver supported by a shaft at lower part of the louver frame and covering front face of the louver frame. Since its opening and closing may be achieved through a simplified configuration; without complex driving mechanism, and can be controlled by the lever by user under the ventilation louver even though the ventilation device were mounted at a high position, the ventilation louver is adapted to any type of ventilation device with an ornamental panel, which is installed to front face of body frame of a ventilating blower in the ventilation device, which is openable and closable. Again referring to FIGS. 1 and 5, a heat-insulating material 35 is provided on the inner surface, i.e., surface facing the wind tunnel 6, of the movable louver 15, which may be heat-insulating sponge. When cool outdoor air is sucked into ventilation device during operation, the cool air blows directly to the heat-insulating material 35, rather than inner surface of the movable louver 15. Since the heat-insulating material 35 separates the cool air from the movable louver 15, temperature difference between the movable louver 15 and indoor air becomes small. Thus, when indoor air contacts outer surface of the movable louver 15, it would not be condensed so as to prevent occurrence of dew.

To edge of the upside bracket and right and left side bracket of the movable louver 15, a double convex bar structure is provided, comprising an inner convex bar 51 and an outer convex bar 52 with a space 55 therebetween. When the ventilation device body 5 is in operation, cool air is sucked along the wind tunnel 6 and blown to the heat-insulating material 35 of the movable louver 15, and then spread towards peripheral upper side and the right and left sides. With the double convex bar structure, condensed water or dew will generated in the space 55 between the inner convex bar 51 and the outer convex bar 52 of the double convex bar structure when the inner convex bar 51 is blown by cool air. Here, a protruding bar 56 is designed to connect the inner convex bar 51 and the outer convex bar 52, forming a water reservoir between the protruding bar 56, the inner convex bar 51 and the outer convex bar 52. The condensed water in the space 55 may be stored in the reservoir. As water storage is not large, it is easy to be evaporated. Further, when cool outdoor air contacts the heat-insulating material 35, it will flow towards peripheral upper side and the right and left sides and contacts the inner convex bar 51, and then flow into room. The cold-energy of cool air will not be transferred to the outer convex bar 52 due to the space 55. Thus, the space functions to prevent temperature of the outer convex bar 52 from being decreased and thus avoiding condensed water or dew generated on the outer surface of the outer convex bar 52.

Figure 11:
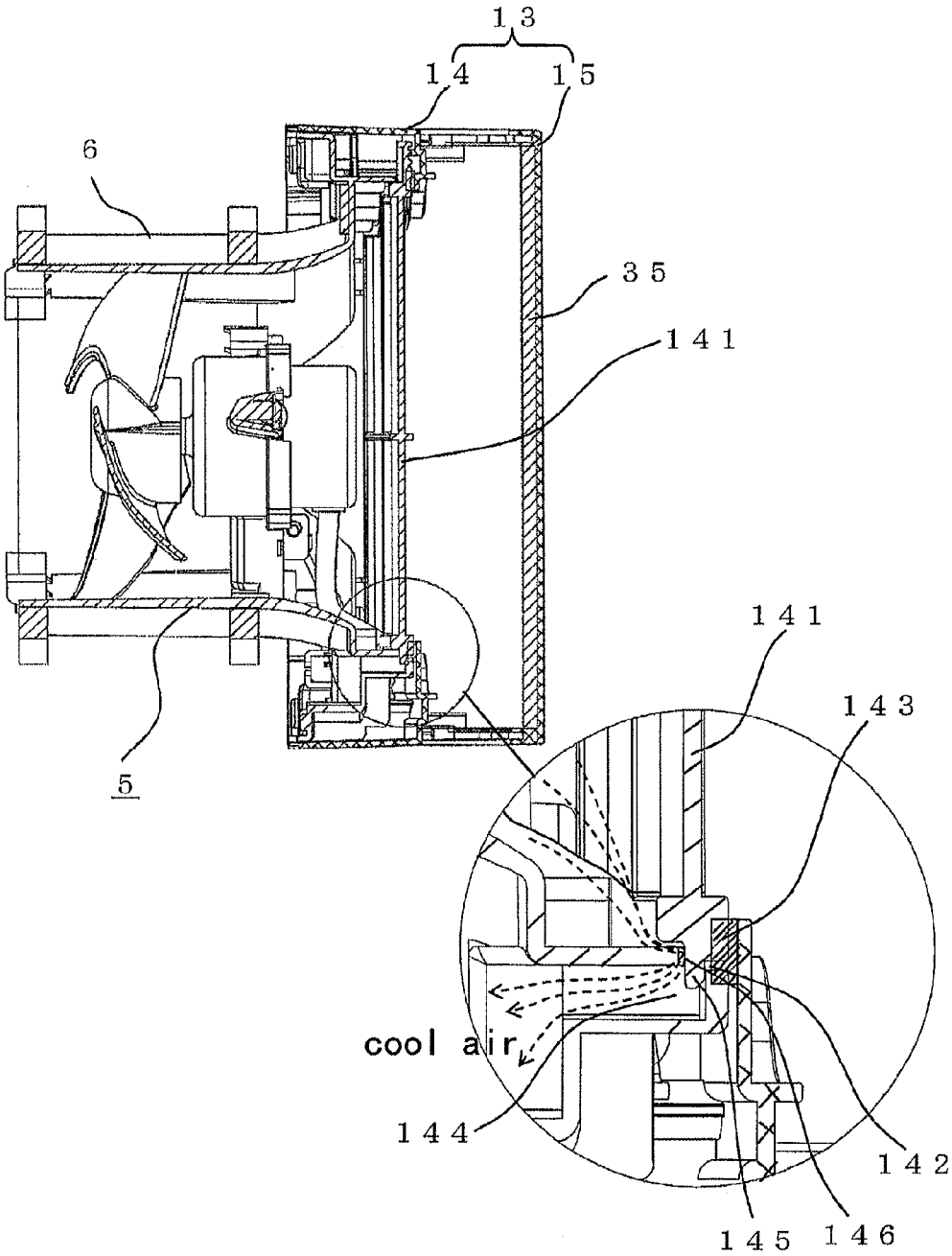
FIG. 11 is a sectional view of that illustrated in FIG. 12 along A-A direction.

As shown in FIGS. 1, 11 and 12, the ventilation device body 5 is provided with a filter bracket 141, which is configured in such a shape to cover front opening of the ventilation device body 5. The filter bracket 141 is provided with a wedge sheet 145 on one side and the ventilation device body 5 is provided with a corresponding opening 146 into which the wedge sheet 145 is inserted. The other side of the filter bracket 141 is installed to the ventilation device body 5 by a snap-fitted structure. On inner side, i.e., the side facing the wind tunnel 6, of the louver frame 14, a seal sponge 143 as a seal structure, is provided in the gap 142 between the filter bracket 141 and the ventilation device body 5. Since a gap 142 exists between the filter bracket 141 and the ventilation device body 5 after the filter bracket 141 is snapped to the ventilation device body 5, the sucked cool air to indoor space may pass through the gap 142, blow to inside of the louver frame 14 and generate condensed water or dew on the upper side and right and left sides of the louver frame 14 when the louver frame 14 is installed in the ventilation device body 5 and the ventilating fan is in operation. When the ventilation louver 13 is installed to the ventilation device body 5, the seal sponge 143 disposed on inner face of the louver frame 14, as shown in Figures, overlaps with the gap 142 between the filter bracket 141 and the ventilation device body 5. That is, the gap 143 is shielded or blocked by the seal sponge 143. Here, the seal sponge may be deformed, and function to block wind and insulate heat, thus avoiding generation of condensed water or dew there. By configuring the seal sponge in mentioned manner, the seal sponge 143 blocks the gap 142 between the filter bracket 141 and the ventilation device body 5, and functions to seal and thus prevent condensed water from occurrence on the louver frame 14.

Referring to FIGS. 11 and 12, the ventilation device body 5 is further provided with a wind guiding structure 144 at a position where the ventilation device body 5 snaps with the filter bracket 141. The wind guiding structure 144 is configured to be a passage extending from the opening 146 in the ventilation device body 5 into which the wedge sheet 145 of the filter bracket 141 is inserted towards the wind tunnel 6. With the wind guiding structure 144, cool air is blown along it towards wall shielded by the ventilation device body 5.

As mentioned above, although the seal sponge 143 has been disposed on the inner side face of the louver frame 14 blocking the gap 142 between the filter bracket 141 and the ventilation device body 5, wind still may pass through the opening 146 in the ventilation device body 5 into which the wedge sheet 145 of the filter bracket 141 is inserted due to non-hermetic sealing, leading to wind leakage. That is, cool air blows directly to side of the louver frame 14, leading to generation of condensed water or dew thereon. In order to prevent side wind leakage and thus condensed water on a side of the louver frame 14, the wind guiding structure 144 is provided, through which wind is blown along the passage extending towards the wind tunnel 6 and back to inner of the ventilation device after passing through the opening 146 in the ventilation device body 5 into which the wedge sheet 145 of the filter bracket 141 is inserted. That is, cool air blows to wall shielded by the ventilation device body 5 along the wind guiding structure 144, i.e., space defined by the ventilation device body 5 and wall, thereby avoiding water or dew condensed on side of the louver frame 14.

The invention claimed is:

1. A ventilation device mounted on an inner wall in a wind tunnel communicating between indoor and outdoor sides, comprising:

a ventilation louver, including a louver frame and a movable louver, wherein the louver frame is mounted at a front opening of a ventilation device body of the ventilation device and the movable louver is supported by a movable louver shaft at a lower part of the louver frame and covers a front side of the louver frame, wherein a horizontal distance from a center of gravity of the movable louver to an inner wall at the indoor side is greater than a horizontal distance from the movable louver shaft to the inner wall;

a lever disposed at a lower part of the louver frame to move in a left-right direction along a bottom end face thereof;

a connection element connects the movable louver with the lever between the movable louver and the louver frame, which is configured to be a slidable structure in an up-down direction, and transforms the movement in the left-right direction of the lever to opening and closing movement of the movable louver around the movable louver shaft, wherein the lever includes a horizontal slot disposed in its end face facing the lower part of the louver frame opening portion, and a corresponding protrusion plate is disposed to extend in the left-right direction on the lower part of the louver frame opening portion, the protrusion plate is fitted in the slot and slidable in the left-right direction therein.

2. The ventilation device according to claim 1, wherein, the lever includes a handle extending downward and projecting to indoor room from bottom of the louver frame.

3. The ventilation device according to claim 1, wherein, the movable louver is provided with a rotation guide plate standing on its rear side, the rotation guide plate including an oblique rotation guide slot;

the connection element is U-shaped and the U-shaped connection element is provided with a protrusion part on a front end portion in an up-down direction thereof, the protrusion part of the connection element being fitted and slidable in the rotation guide slot at a center of both sides of the movable louver;

wherein, the rotation guide plate moves forward and backward when the connection element moves in the up-down direction.

4. The ventilation device according to claim 3, wherein, the rotation guide slot includes at least two slot parts with different gradients, with respect to a horizontal plane, the slot part with a smaller gradient of the rotation guide slot being disposed in the rear side while the slot part with a greater gradient being disposed in the front side.

5. The ventilation device according to claim 3, wherein, the rotation guide slot is configured to be an arc-shaped slot.

6. The ventilation device according to claim 1, wherein, the inner surface of the movable louver is provided with a heat-insulating material.

7. The ventilation device according to claim 6, wherein, the movable louver is provided with double convex bars on an upside bracket and right and left side brackets, with a space between the double convex bars.

8. The ventilation device according to claim 7, further comprising, a protruding bar is disposed in the space to connect an inner convex bar and an outer convex bar and thereby a reservoir is formed between the protruding bar, the inner convex bar and the outer convex bar.

9. The ventilation device according to claim 1, wherein, the ventilation device body is provided with a filter bracket, which is snapped to the ventilation device body and formed in such a shape to cover the front opening of the ventilation device body, a seal sponge is further provided to an inner side of the louver frame to block a gap between the filter bracket and the ventilation device body.

10. The ventilation device according to claim 9, wherein, the ventilation device body includes a wind guiding structure, located at position where the ventilation device body snaps to the filter bracket, through which cool air is blown to a wall shielded by the ventilation device body.

11. A ventilation device mounted on inner wall in wind tunnel communicating between indoor and outdoor sides, comprising:

a ventilation louver, including a louver frame and a movable louver, in which the louver frame is mounted at a front opening of a ventilation device body of the ventilation device and the movable louver is supported by a movable louver shaft at a lower part of the louver frame and covers a front side of the louver frame, wherein a horizontal distance from a center of gravity of the movable louver to an inner wall at the indoor side is greater than a horizontal distance from the movable louver shaft to the inner wall;

a lever is disposed at a lower part of the louver frame to move in a left-right direction along a bottom end face thereof;

a connection element connects the movable louver with the lever between the movable louver and the louver frame, which is configured to be a slidable structure in an up-down direction, and transforms the movement in the left-right direction of the lever to opening and closing movement of the movable louver around the movable louver shaft;

wherein, the connection element includes an oblique lever guiding slot, and the lever includes a lever protrusion fitted in the lever guiding slot, the lever protrusion being slidable in the lever guiding slot, wherein the connection element moves in the up-down direction when the lever moving in the left-right direction.

12. The ventilation device according to claim 11, wherein, the lever protrusion has a cylindrical or elongate shape.

13. The ventilation device according to claim 11, wherein, the connection element is U-shaped and the lever guiding slot is located in center of portion of the U-shape connection element in the left-right direction.

14. The ventilation device according to claim 11, further comprising:

horizontal connection element support portions that are disposed at upper end and lower end of the lever guiding slot for fixing the lever protrusion.

15. The ventilation device according to claim 11, wherein the lever includes a handle extending downward and projecting to indoor room from bottom of the louver frame.

16. The ventilation device according to claim 11, wherein the movable louver is provided with a rotation guide plate standing on its rear side, the rotation guide plate including an oblique rotation guide slot;

the connection element is U-shaped and the U-shaped connection element is provided with a protrusion part on a front end portion in an up-down direction thereof, the protrusion part of the connection element being fitted and slidable in the rotation guide slot at a center of both sides of the movable louver;

wherein, the rotation guide plate moves forward and backward when the connection element moves in the up-down direction.

17. The ventilation device according to claim 11, wherein, the inner surface of the movable louver is provided with a heat-insulating material.

18. The ventilation device according to claim 11, wherein, the ventilation device body is provided with a filter bracket, which is snapped to the ventilation device body and formed in such a shape to cover the front opening of the ventilation device body, a seal sponge is further provided to an inner side of the louver frame to block a gap between the filter bracket and the ventilation device body.

* * * * *